United States Patent [19]

Bonnici et al.

[11] Patent Number: 4,593,504

[45] Date of Patent: Jun. 10, 1986

[54] PRESSURE EQUALIZING ROOF VENT

[75] Inventors: Charles Bonnici; James W. Ballard, both of Livonia, Mich.

[73] Assignee: Jimco Products, Livonia, Mich.

[21] Appl. No.: 701,722

[22] Filed: Feb. 14, 1985

[51] Int. Cl.[4] ..... E04B 7/00

[52] U.S. Cl. ..... 52/199; 52/302; 98/42.1

[58] Field of Search ..... 52/58, 219, 218, 199, 52/303, 302; 98/42.1; 285/192, 55, DIG. 2, DIG. 16

[56] References Cited

U.S. PATENT DOCUMENTS

| | | | |
|---|---|---|---|
| 2,956,495 | 10/1960 | Sublette | 52/58 |
| 3,797,181 | 3/1974 | Nievelt | 52/199 |
| 3,984,947 | 10/1976 | Patry | 52/199 |
| 4,249,758 | 2/1981 | Harris | 285/158 |
| 4,442,643 | 4/1984 | Stadheim | 52/199 |

FOREIGN PATENT DOCUMENTS

| | | | |
|---|---|---|---|
| 2027387 | 12/1971 | Fed. Rep. of Germany | 52/199 |
| 3151940 | 7/1983 | Fed. Rep. of Germany | 52/303 |
| 2503330 | 10/1982 | France | 98/42.01 |
| 2052044 | 1/1981 | United Kingdom | 52/302 |

*Primary Examiner*—Henry E. Raduazo

*Attorney, Agent, or Firm*—Cullen, Sloman, Cantor, Grauer, Scott & Rutherford

[57] ABSTRACT

An improved vent for equalizing the pressure on the roof of a building includes a tube provided with a one-way acting valve therein for allowing air to pass from within the building to the open atmosphere but preventing entry of moisture air into the interior of the building. The valve includes a flexible flapper valve member mounted over an opening in a metal plate secured in face-to-face contact with an annular flange on one end of the tube. Condensation of moisture within the tube is prevented by a thin layer of insulation which lines the tube and which, in one embodiment of the invention, includes an integral annular flange sandwiched between the tube and the valve plate to prevent moisture condensation on the plate. An annular depression in the valve plate surrounding the valve opening diverts condensed moisture from the flapper valve to prevent valve seizure due to frozen moisture.

16 Claims, 5 Drawing Figures

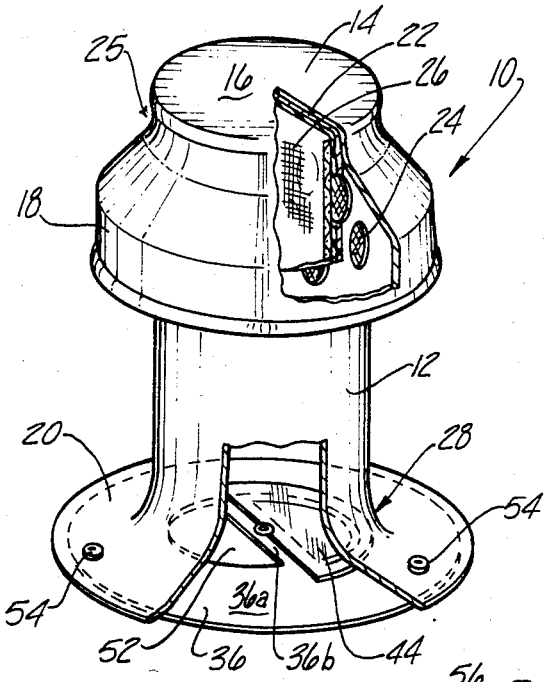
Fig-1
Fig-2
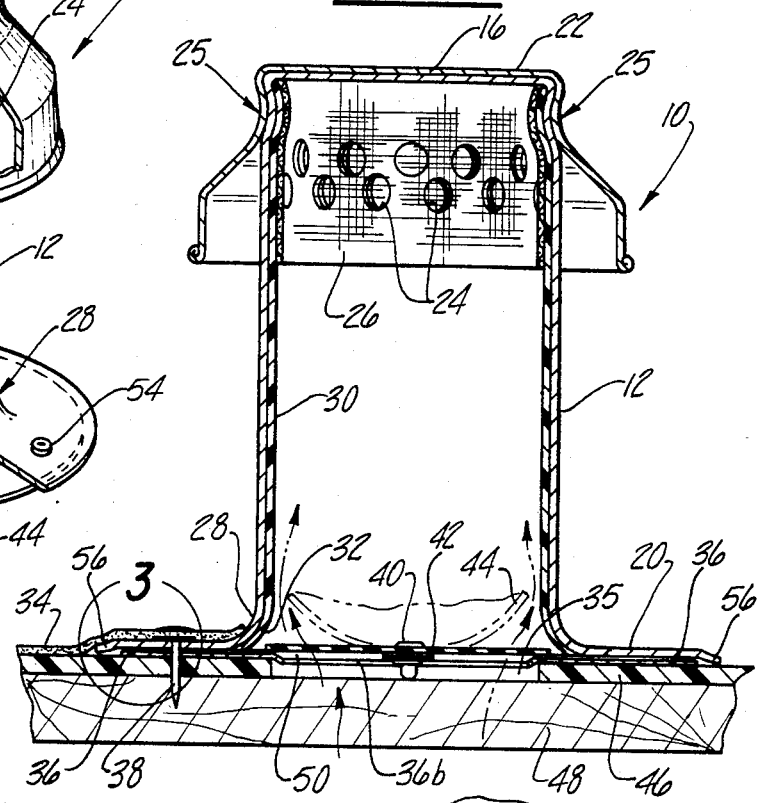
Fig-3
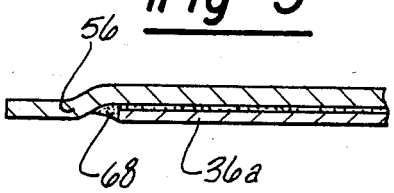
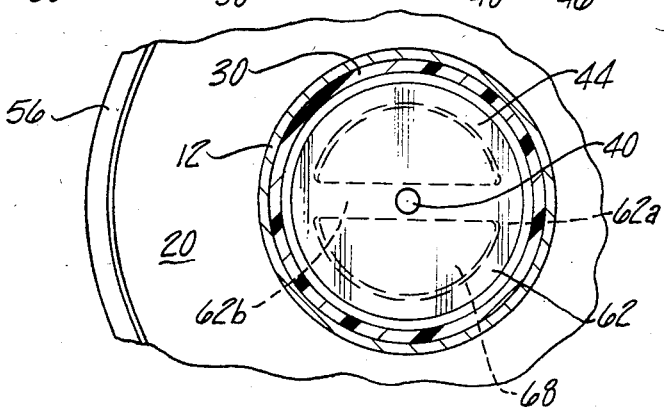
Fig-5
Fig-4
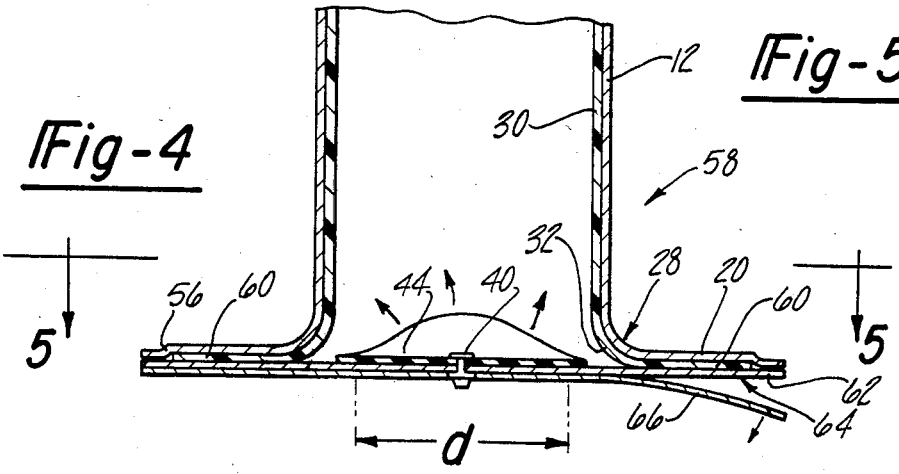

PRESSURE EQUALIZING ROOF VENT

TECHNICAL FIELD

The present invention broadly relates to roof vents which permit the escape of air into the open atmosphere, and deals more particularly with pressure equalization type vents having flow control valves which allow escape of air in order to equalize the air pressure on the roof but which prevent entry of outside air and moisture into the building.

BACKGROUND ART

Various types of roof vents for buildings have been devised in the past for various purposes including ventilation and air pressure equalization. Air pressure equalization is particularly important in building constructions having so called membrane type flat roofs in which a flexible, weather impervious membrane covers the roof. By virtue of its flexibility, the membrane covering can expand and contract in response temperature extremes and has therefore been used more frequently in recent years, particularly in commercial buildings. Wind blowing across the top of a membrane type roof can create areas of reduced air pressure above the roof which create forces that result in "ballooning", and in some cases, rupture of the membrane.

Pressure relieving roof vents are employed to equalize the pressure on the membrane and thereby avoid adverse affects on the membrane such as ballooning. Pressure relieving roof vents employed in the past typically comprise an upstanding tube mounted on the roof at a position overlying an opening in the membrane, thereby placing the area of the roof beneath the membrane in communication with open atmosphere. A one-way flapper valve mounted in the bottom of the tube allows the escape of air from within the roof beneath the membrane to the open atmosphere but prevents entry of air into the roof. A cap covering the top of the tube prevents atmospheric moisture and rain from entering the tube.

Pressure relieving roof vents of the type described above were less than completely satisfactory for several reasons. For example, moisture often formed on the interior sidewalls of the tube and/or on the value within the tube as a result of the condensation of moisture due to the warm air in the tube being exposed to the cool sidewalls of the tube when the atmospheric temperature is less than that of the air within tube. This moisture is drawn by gravity down the sidewall of the tube, accumulates on the flapper valve and gains entry into the roof when the valve opens. Entry of moisture through the membrane beneath the tube can result in serious damage and degradation of structural portions of the roof, such as wood or fiberous underlayment since the underlayment is directly exposed beneath the vent opening. Moreover, accumulated moisture at the bottom of the tube which overlies the flapper valve can freeze in cold weather, thereby resulting in seizure of the flapper valve.

Another problem associated with prior art roof vents involves the manner of mounting the vent on the roof. In the past, in order to temporarily secure the vent on the roof prior to applying the overlayment on the roof, it was necessary to tack the vent to the underlayment using nails or the like. In some installations this approach to the problem was undesirable since, once tacked down, it was impossible to readily adjust the position of the vent. Moreover, the use of nails for this purpose resulted in piercing of the membrane, thus making it necessary to assure that the nail apertures were subsequently sealed to prevent moisture entry.

SUMMARY OF THE INVENTION

It is thus a primary object of the present invention to overcome each of the deficiencies of the prior art vent discussed above. This, and further objects of the invention will be made clear or will become apparent during the course of a detailed description of the invention hereinafter provided.

According to the present invention, a vent for equalizing the air pressure exerted above and below the roof of a building includes a generally cylindrical metal tube extending upwardly from the roof and through which air may pass from the interior of the building into the open atmosphere. A flange on one end of the tube is provided for mounting the vent on the roof and is adapted to overlay the roof. The valve assembly for controlling the flow of air through the tube includes a metal plate extending across the tube and secured to the flange, the plate being disposed between the roof and the flange and including a central opening therein through which air may pass. The valve assembly further includes a flexible flapper valve member secured to the plate and overlying the valve plate opening, thereby to allow air to exit from the building into the open atmosphere but preventing air from entering the building through the vent. According to one aspect of the invention, a thin sleeve of thermally insulating material lines the wall of the tube and prevents condensation of moisture on the interior walls of the tube as a result of relatively warm air within the tube meeting the cool sidewalls of the tube. According to another aspect of the invention, the liner may include an integrally formed flange sandwiched between the valve plate and the flange of the tube in order to thermally insulate the plate from the tube and thereby prevent formation of condensation on the valve plate.

A still further feature of the invention resides in the provision of a depression or recess in the valve plate beneath the flapper valve member which diverts moisture away from the flapper valve member, thereby preventing seizure of the valve due to frozen condensation.

Another feature of the invention relates to the use of an adhesive on the bottom face of the valve plate and which is normally covered, prior to installation, with a removable cover. The preapplied adhesive is employed to temporarily hold the vent on the roof during installation thereof.

As a result of the foregoing features, the various portions of the vent may be formed of a metal material such as spun aluminum, yet the problems associated with moisture condensation as a result of the thermally conductive metal are obviated.

BRIEF DESCRIPTION OF DRAWINGS

In the drawings, which form an integral part of the specification and are to be read in conjunction therewith, and in which like reference numerals are employed to designate identical components of the various views:

FIG. 1 is a perspective view of the roof vent of the present invention, portions being broken away in section for clarity;

FIG. 2 is a longitudinal, sectional view of the roof vent shown in FIG. 1 mounted on a roof of the type having a membrane type covering, the open position of the flapper valve being indicated in the phantom;

FIG. 3 is an enlarged, sectional view of the area encircled with the reference numeral 3 in FIG. 2;

FIG. 4 is a fragmentary, longitudinal sectional view of the bottom of an alternate form of the roof vent of the present invention, with the flapper valve in an open position; and, FIG. 5 is a sectional view taken along the line 5—5 in FIG. 4.

DETAILED DESCRIPTION OF A PREFERRED EMBODIMENT

Referring first to FIGS. 1 and 2, the present invention broadly involves a roof vent 10 for equalizing the air pressure exerted on the top and bottom of the roof of a building or similar structure. The roof may be of the type including a structurally supporting underlayment board 48 formed of wood, fiberous material or other supporting surface, and although not specifically shown in the drawings it is to be understood that suitable rafters, beams, trusses or the like are employed to support the underlayment 48. A thin membrane 46 formed of rubber or other suitable synthetic material which is impervious to the weather overlies and protectively covers the underlayment 48. As will be discussed later in more detail, the vent 10 is mounted over a generally circular opening 35 provided in the membrane 46.

The vent 10 includes a vertically extending, cylindrical tube 12 and a cap 14 covering the upper end of the tube 12. The cap 14 is provided with a substantially flat, circular top 16 having a diameter substantially the same as the tube 12, and downwardly extending sidewalls 18 which are spaced radially outward from the tube 12. The tube may have a closed top wall 22 beneath the top 16 of the cap 14. The cap 14 may be secured to the tube 12 by any of various techniques including welding, riveting, or a "spinning" technique shown in U.S. Pat. No. 4,461,066 issued July 24, 1984, in which the cap 14 and tube 12 are conjugally deformed to define a joint 25. Alternatively, the cap 14 and tube 12 may be of a one piece construction made according to the method disclosed in U.S. Pat. No. 4,370,876 issued Feb. 1, 1983. The cap 14 as well as the tube 12 are preferably formed of metal such as aluminum.

The upper end of the tube 12 is provided with a plurality of circumferentially spaced apertures 24 therein which place the open interior of the tube in communication with the open atmosphere, thus allowing air to exit from the tube 12 beneath the sidewalls of the cap 18 to the surrounding atmosphere. A screen 26 suitably secured within the tube 12 covers the aperture 24.

The bottom of the tube 12 include an annular, outwardly turned, horizontal flange 20 which is preferably formed integral with the sidewalls of the tube and joins the tube 12 at a bend 28.

A one-way acting valve assembly mounted in the bottom of the tube 12, comprises a generally circular valve plate 36 and a circular flapper valve 44. Valve plate 36 includes a ring shaped outer portion 36A which is disposed in face-to-face contact with flange 20 and may be secured thereto by rivets 54 or the like. The bottom face of the ring shaped portion 36A overlies and engages the membrane 46, and surrounds the membrane opening 35. A central circular opening 52 in the valve plate 36 is dissected into two essentially equal halves by a leg portion 36B which extends diametrically between opposite sides of the ring shaped portion 36A. As best seen in FIG. 2, the valve plate 36 includes a central depression 50 therein which is coextensive with the leg portion 36B beneath the flapper valve member 44. The margin of the ring shaped portion 36A which surrounds the valve opening 52 forms a valve seat for supporting the peripheral edge of flapper valve member 44. The flapper valve member 44 may be formed of any suitable flexible material, such as rubber and is secured to the leg portion 36B by means of a rivet 42. A spacing washer 42 mounted on the rivet 40 and disposed between the flapper valve member 44 and the leg portion 36B supports the central portion of the flapper valve member 44 in spaced relationship to the leg portion 36B. The diameter of the flapper valve member 44 is approximately equal to the inside diameter of the cylindrical air flow path through the tube 12 and the opening 52 is of maximum diameter relative to flapper valve member 44 in order to allow a maximum amount of air to escape through the vent 10.

As shown in FIG. 3, as an alternative to securing the valve plate 36 to the flange 20 by the rivets 44, this securement may be achieved by placing a weld 68 between the outer edge of the ring shaped portion 36A and a downwardly turned outer edge 56 of the flange 20.

In order to thermally insulate the inside wall of the tube 12, the tube 12 is lined with a relatively thin layer 30 of insulation, preferably comprising a cellular, synthetic material such as polyurethane or polystyrene. The insulting liner 30 is preferably structurally self-supporting and is closely received within the tube 12 in order to obviate the need for securing the liner 30 to the tube 12 by adhesives or the like. The insulative liner 30 includes an outwardly extending flange 32 at the bottom thereof which follows the contour of the bend 28 in order to maximize the interior wall surface which is insulated. The top of the liner 30 engages the end 22 of the tube 12, while the bottom thereof engages the top face of valve plate 36.

The vent 10 is mounted on the roof by means of nails 38 driven through the flange 20 and valve plate 36, and a weather tight seal between the flange 20 and the roof is achieved by applying caulking or an overlayment 34 over the edge 56 of the flange 20.

Attention is now directed to FIGS. 4 and 5 which depict an alternate form 58 of the vent of the present invention. The upper portions of the tube 12 and related cap are substantially identical to those previously described with respect to FIGS. 1 and 2. A valve plate 62, broadly similar to that previously described is formed from a suitable metal and includes a central opening 68 therein which is bisected by a leg portion 62B. For illustrative purposes, the valve plate 62 is substantially flat and does not include a depression therein such as that previously described in connection with valve plate 36 shown in FIGS. 1 through 3.

The liner 30 is identical to that previously described but includes a flange portion 60 at the bottom thereof which extends radially outward from the flange 32 and is sandwiched between flange 20 and the outer periphery of the valve plate 62, thereby thoroughly insulating the valve plate 62 from the flange 20.

The bottom face 64 of the valve plate 62 is provided with a preapplied adhesive which is temporarily covered with a removable sheet 66 of material which is only mildly adherent to the adhesive. The sheet 66 may be peeled away to expose the adhesive lower surface 64 of valve plate 62 immediately prior to installation of the vent 58 on the roof. It should be noted here that the preapplied adhesive and removable cover sheet 66 may also be used with the embodiment of the vent 10 shown in FIGS. 1–3.

In use, after the opening 35 in the membrane 46 has been formed, the cover sheet 66 is removed and the vent is then placed on the roof. The adhesive bottom face of the valve plate 62 firmly holds the vent 58 in place until it is securely nailed to the underlayment 48 or a suitable caulking or overlayment 34 is applied around the flange 20.

In operation, the tube liner 30 insulates the sidewalls of the tube 12 so that air within the tube 12 which is normally somewhat warmer than the surrounding atmosphere during cold weather prevents the air from contacting the cool sidewalls of the tube 12 which might result in condensation of moisture on the interior sidewall. In a similar manner, condensation is prevented from forming on the valve plate 62 by virtue of the insulating flange portion 66 of the liner. Thus, substantially the entire surface area of the vent which is disposed between the air within the tube 12 and the surrounding atmosphere is insulated from the metal portion of the tube by the insulating liner.

In the event that some moisture does form within the tube 12 and is drawn downwardly by gravity onto the valve plate 36, such moisture is diverted downwardly beneath the flapper valve member 44 by virtue of the depression 50 and cannot result in seizure of the valve in the event such moisture freezes.

From the foregoing, it is apparent that the air pressure equalizing roof vent described above not only provides for the reliable accomplishment of the objects of the invention but does so in a particularly effective and economical manner. It is recognized, of course, that those skilled in the art may make various modification or additions to the preferred embodiment chosen to illustrated the invention without departing from the spirit and scope of the present contributions of the art. Accordingly, it is to be understood that the protection sought and to be afforded hereby should be deemed to extend to the subject matter claimed and all equivalents thereof fairly within the scope of the invention.

What is claimed is:

1. A vent for equalizing air pressure exerted on a roof of a building, comprising:

a generally cylindrical, metal tube extending upwardly from said roof and through which air may pass from the interior of said building into the open atmosphere;

a flange on one end of said tube for mounting said vent on said roof, said flange being adapted to overlie said roof;

a valve assembly for controlling the flow of air through said tube, said valve assembly including a metal plate extending across said tube and secured to said flange, said plate being disposed between said roof and said flange, said plate including a central opening therein through which air may pass, said valve assembly further including a valve member mounted on said plate for selectively closing said opening; and, means sandwiched between said flange and said plate for thermally insulating said flange and said tube from said plate to prevent condensation of moisture on said plate.

2. The vent of claim 1, wherein said flange extends circumferentially continuously around and is formed integral with said tube, and said insulating means includes a layer of cellular synthetic material.

3. The vent of claim 2, including a layer cellular, synthetic material lining the interior wall of said tube to thermally insulate the air within said tube from said tube, whereby to prevent condensation of moisture within said tube on said interior wall thereof.

4. The vent of claim 3, wherein the layers of said cellular synthetic material lining said tube and sandwiched between said plate and said flange are formed integral with each other.

5. The vent of claim 3, wherein said material comprises polystyrene foam.

6. The vent of claim 3, wherein said material comprises polyurethane foam.

7. The vent of claim 1, wherein said valve member overlies and engages said plate, and said plate includes a depression therein surrounding the periphery of said opening and spaced below said valve member, said depression preventing contact over a substantial area of said valve member with moisture forming on said plate beneath said valve member.

8. The vent of claim 1, including a coating of adhesive on said plate surrounding said opening therein, and a removable cover overlying said adhesive prior to installation of said vent on said roof, said adhesive functioning to secure said vent on said roof during installation of said vent on said roof.

9. A roof vent of the type including the combination of a hollow tube through which air may escape through the roof of a structure, a valve plate extending across the air flow path through said tube and having a central circular opening therein through which air may flow, and a flexible, planar valve member secured to said plate and overlying said opening, the improvement comprising:

said circular opening having an inwardly beveled edge adjacent the outer perimeter of said valve member forming a depression in said plate beneath said valve member, said depression direction moisture away from said valve member and preventing seizure of said valve member against said plate resulting from frozen moisture across a substantial area between said plate and said valve member.

10. The vent of claim 9, wherein said depression is defined by a ring shaped portion circumscribing said opening in said plate, and a leg portion extending diametrically across said opening and connecting opposite sides of said ring shaped portion.

11. The vent of claim 9, wherein said improvement further includes a spacer between said valve member and said leg portion for maintaining a preselected spacing between central portions of said valve member and said leg portion.

12. The vent of claim 9, wherein said improvement further includes a coating of adhesive on said plate surrounding said opening therein, and a removable cover overlying said adhesive coating prior to installation of said vent on said roof, said adhesive functioning to temporarily secure said vent on said roof during installation of said vent on said roof.

13. A roof vent for a building, comprising:

a tubular member through which air may flow from within said building to the open atmosphere, said tubular member having upper and lower ends through which air may pass;

means on said lower end of said tubular member for mounting said vent on said roof;

a valve mounted on the lower end of said tube for controlling the flow of air through said tubular member; and, a sleeve of thermally insulating material lining the interior wall of said tubular member to prevent condensation of moisture within said tubular member.

14. The roof vent of claim 13, wherein:

said mounting means includes an annular flange on said lower end of said tubular member, said flange extending radially outward from said tubular member and supporting said tubular member on said roof, said sleeve including an annular flange portion extending radially outward from said tubular member and underlying the flange attached to said tubular member, and, said valve includes a plate underlying the flange attached to said tubular member, the annular portion of said sleeve being sandwiched between the annular flange attached to said tubular member and said plate, whereby to prevent condensation of moisture on said plate.

15. The vent of claim 14, wherein said mounting means includes a coating of adhesive on the lower face of said plate and a removable cover covering said adhesive and adapted to be removed prior to installation of said roof vent on said roof.

16. A roof vent for a building, comprising:

a tubular member through which air may flow from within said building to the open atmosphere, said tubular member having upper and lower ends through which air may pass;

means on said lower end of said tubular member for mounting said vent on said roof;

a valve mounted on the lower end of said tube for controlling the flow of air through said tubular member;

a sleeve of thermally insulating material lining the interior wall of said tubular member to prevent condensation of moisture within said tubular member;

said mounting means includes an annular flange on said lower end of said tubular member, said flange extending radially outward from said tubular member and supporting said tubular member on said roof;

said sleeve including an annular flange portion extending radially outward from said tubular member and underlying the flange attached to said tubular member; and, said valve includes a plate underlying the flange attached to said tubular member, the annular portion of said sleeve being sandwiched between the annular flange attached to said tubular member and said plate, whereby to prevent condensation of moisture on said plate.

* * * * *